US007291077B2

(12) United States Patent
Sajima

(10) Patent No.: US 7,291,077 B2
(45) **Date of Patent: *Nov. 6, 2007**

(54) GOLF BALL

(75) Inventor: Takahiro Sajima, Kobe (JP)

(73) Assignee: SRI Sports Limited, Kobe-Shi, Hyogo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 11/129,399

(22) Filed: May 16, 2005

(65) Prior Publication Data

US 2005/0272532 A1 Dec. 8, 2005

(30) Foreign Application Priority Data

Jun. 7, 2004 (JP) ..... 2004-168408

(51) Int. Cl.
*A63B 37/12* (2006.01)

(52) U.S. Cl. ..... 473/383

(58) Field of Classification Search ..... 473/383–385
See application file for complete search history.

(56) References Cited

U.S. PATENT DOCUMENTS 4,813,677 A * 3/1989 Oka et al. ..... 473/384
5,338,039 A 8/1994 Oka et al.
5,735,757 A 4/1998 Moriyama
6,986,720 B2 * 1/2006 Sajima et al. ..... 473/383
7,052,415 B2 * 5/2006 Sasaki et al. ..... 473/383
2006/0116220 A1 * 6/2006 Ohama et al. ..... 473/371
2006/0116222 A1 * 6/2006 Sajima et al. ..... 473/383

* cited by examiner

*Primary Examiner*—Raeann Trimiew
(74) *Attorney, Agent, or Firm*—Birch, Stewart, Kolasch & Birch, LLP

(57) ABSTRACT

Golf ball 2 has numerous dimples 8 formed on its surface. The dimple 8 has a first side wall face 14, a second side wall face 16 that is positioned to the bottom side of this first side wall face 14, and a bottom face 18 that is positioned to the bottom side of this second side wall face 16. Curvature radius R1 of the first side wall face 14 is equal to or greater than a virtual curvature radius Rx. Curvature radius R2 of the second side wall face 16 is smaller than the virtual curvature radius Rx. Curvature radius R3 of the bottom face 18 is equal to or greater than the virtual curvature radius Rx. Depth d1 of the first side wall face 14 is 0.10 times or greater and 0.50 times or less of the depth d of the dimple 8. Maximum diameter D2 of the second side wall face 16 is 0.60 times or greater and 0.95 times or less of the diameter D1 of the dimple 8.

13 Claims, 6 Drawing Sheets

GOLF BALL

This application claims priority on Patent Application No. 2004-168408 filed in JAPAN on Jun. 7, 2004, the entire contents of which are hereby incorporated by reference.

BACKGROUND OF THE INVENTION

1. Field of the Invention

The present invention relates to golf balls. More particularly, the present invention relates to improvement of dimples of a golf ball.

2. Description of the Related Art

Golf balls have numerous dimples on the surface thereof. In general, golf balls have single radius dimples having a cross-sectional shape with single curvature radius, or double radius dimples having a cross-sectional shape with two curvature radii. A role of the dimples involves causing turbulent flow separation through disrupting the air flow around the golf ball during the flight. This role is referred to as a "dimple effect". By causing the turbulent flow separation, a separating point of air from the golf ball shifts backwards leading to the reduction of a drag. The turbulent flow separation promotes the differential between the separating points at the upper and lower sides of the golf ball, which result from the backspin, thereby enhancing the lift force that acts upon the golf ball. Excellent dimples disturb the air flow more efficiently.

A variety of proposals with respect to the cross-sectional shape of the dimples in an attempt to improve flight performances have been made. U.S. Pat. No. 5,338,039 discloses dimples having a shape with the gradient of a slope disposed in the vicinity of the edge being greater than that of a slope at the bottom part. U.S. Pat. No. 5,735,757 discloses dimples having a cross-sectional shape given by double radius.

Top concern to golf players for golf balls is the travel distance. In light of elevation of the travel distance, there remains room for an improvement of the cross-sectional shape of the dimple. An object of the present invention is to provide a golf ball that has improved dimples, and is excellent in the flight performance.

SUMMARY OF THE INVENTION

The golf ball according to the present invention has numerous dimples on the surface thereof.

Ratio of number of dimples having:

(1) a first side wall face that has a curvature radius R1 which is equal to or greater than a virtual curvature radius Rx;

(2) a second side wall face that is positioned to the bottom side of this first side wall face and has a curvature radius R2 which is smaller than the virtual curvature radius Rx; and (3) a bottom face that is positioned to the bottom side of this second side wall face and has a curvature radius R3 which is equal to or greater than the virtual curvature radius Rx; occupying total number of the dimples is equal to or greater than 50%. According to the present invention, the phantom curvature radius Rx means the curvature radius of a phantom dimple. This phantom dimple means a single radius dimple having a diameter that is equal to the diameter of the dimple, and having a volume that is equal to the volume of the dimple. Preferably, the depth of the first side wall face is 0.10 times or greater and 0.50 times or less of the depth of the dimple. Preferably, maximum diameter of the second side wall face is 0.60 times or greater and 0.95 times or less of the diameter of the dimple. Preferably, the first side wall face, the second wall face and the bottom face are protruded downward.

According to this golf ball, direction of the air flow from a land toward the center of the dimple varies three times stepwise. This dimple disturbs air flow more efficiently. This golf ball is excellent in flight performances.

DESCRIPTION OF THE PREFERRED EMBODIMENTS

The present invention is hereinafter described in detail with appropriate references to the accompanying drawing according to the preferred embodiments of the present invention.

Figure 1:
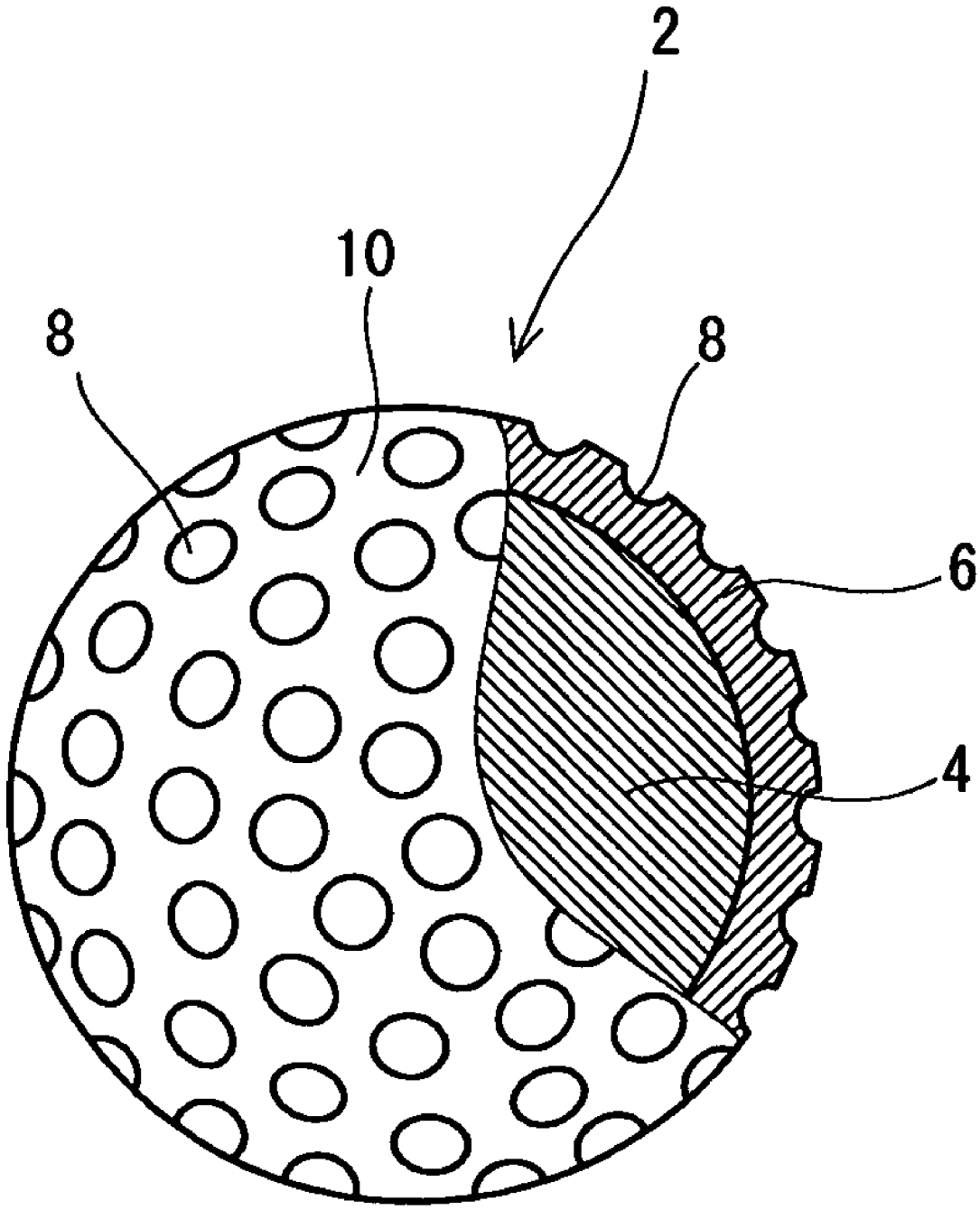
FIG. 1 is a schematic cross-sectional view illustrating a golf ball according to one embodiment of the present invention.

A golf ball 2 illustrated in FIG. 1 has a spherical core 4 and a cover 6. Numerous dimples 8 are formed on the surface of the cover 6. Of the surface of the golf ball 2, part other than the dimples 8 is a land 10. This golf ball 2 has a paint layer and a mark layer to the external side of the cover 6, although these layers are not shown in the Figure.

This golf ball 2 has a diameter of from 40 mm to 45 mm. From the standpoint of conformity to a rule defined by United States Golf Association (USGA), the diameter is preferably equal to or greater than 42.67 mm. In light of suppression of the air resistance, the diameter is preferably equal to or less than 44 mm, and more preferably equal to or less than 42.80 mm. Weight of this golf ball 2 is 40 g or greater and 50 g or less. In light of attainment of great inertia, the weight is preferably equal to or greater than 44 g, and particularly preferably equal to or greater than 45.00 g. From the standpoint of conformity to a rule defined by USGA, the weight is preferably equal to or less than 45.93 g.

The core 4 is formed through crosslinking of a rubber composition. Illustrative examples of the base rubber for use in the rubber composition include polybutadienes, polyisoprenes, styrene-butadiene copolymers, ethylene-propylene-diene copolymers and natural rubbers. Two or more kinds of the rubbers may be used in combination. In light of the resilience performance, polybutadienes are preferred, and particularly, high cis-polybutadienes are preferred.

For crosslinking of the core 4, a co-crosslinking agent is usually used. Preferable examples of the co-crosslinking agent in light of the resilience performance include zinc acrylate, magnesium acrylate, zinc methacrylate and magnesium methacrylate. Into the rubber composition, an organic peroxide may be preferably blended together with the co-crosslinking agent. Examples of suitable organic peroxide include dicumyl peroxide, 1,1-bis(t-butylperoxy)-3,3,5-trimethylcyclohexane, 2,5-dimethyl-2,5-di(t-butylperoxy)hexane and di-t-butyl peroxide.

Various kinds of additives such as a filler, a sulfur compound, an anti-aging agent, a coloring agent, a plasticizer, a dispersant and the like may be blended at an appropriate amount into the rubber composition of the core 4 as needed. Crosslinked rubber powder or synthetic resin powder may be blended into the rubber composition.

The core 4 has a diameter of equal to or greater than 30.0 mm, and particularly equal to or greater than 38.0 mm. The core 4 has a diameter of equal to or less than 42.0 mm, and particularly equal to or less than 41.5 mm. The core 4 may be composed of two or more layers.

Polymer that is suitable for the cover 6 is an ionomer rein. In particular, a copolymer of α-olefin and an α,β-unsaturated carboxylic acid having 3 to 8 carbon atoms in which part of the carboxylic acid is neutralized with a metal ion is suitable. Examples of the preferable α-olefin include ethylene and propylene. Examples of the preferable α,β-unsaturated carboxylic acid include acrylic acid and methacrylic acid. Illustrative examples of the metal ion for use in the neutralization include sodium ion, potassium ion, lithium ion, zinc ion, calcium ion, magnesium ion, aluminum ion and neodymium ion. The neutralization may also be carried out with two or more kinds of the metal ions. In light of the resilience performance and durability of the golf ball 2, examples of the particularly suitable metal ion include sodium ion, zinc ion, lithium ion and magnesium ion.

Other polymer may be used in place of or together with the ionomer resin. Illustrative examples of the other polymer include thermoplastic styrene elastomers, thermoplastic polyurethane elastomers, thermoplastic polyamide elastomers, thermoplastic polyester elastomers and thermoplastic polyolefin elastomers.

Into the cover 6 may be blended a coloring agent such as titanium dioxide, a filler such as barium sulfate, a dispersant, an antioxidant, an ultraviolet absorbent, a light stabilizer, a fluorescent agent, a fluorescent brightening agent and the like in an appropriate amount as needed. The cover 6 may be blended with powder of a highly dense metal such as tungsten, molybdenum or the like for the purpose of adjusting the specific gravity.

The cover 6 has a thickness of equal to or greater than 0.5 mm, and particularly equal to or greater than 0.8 mm. The cover 6 has a thickness of equal to or less than 2.5 mm, and particularly equal to or less than 2.2 mm. The cover 6 has a specific gravity of equal to or greater than 0.90, and particularly equal to or greater than 0.95. The cover 6 has a specific gravity of equal to or less than 1.10, and particularly equal to or less than 1.05. The cover 6 may be composed of two or more layers.

Figure 2:
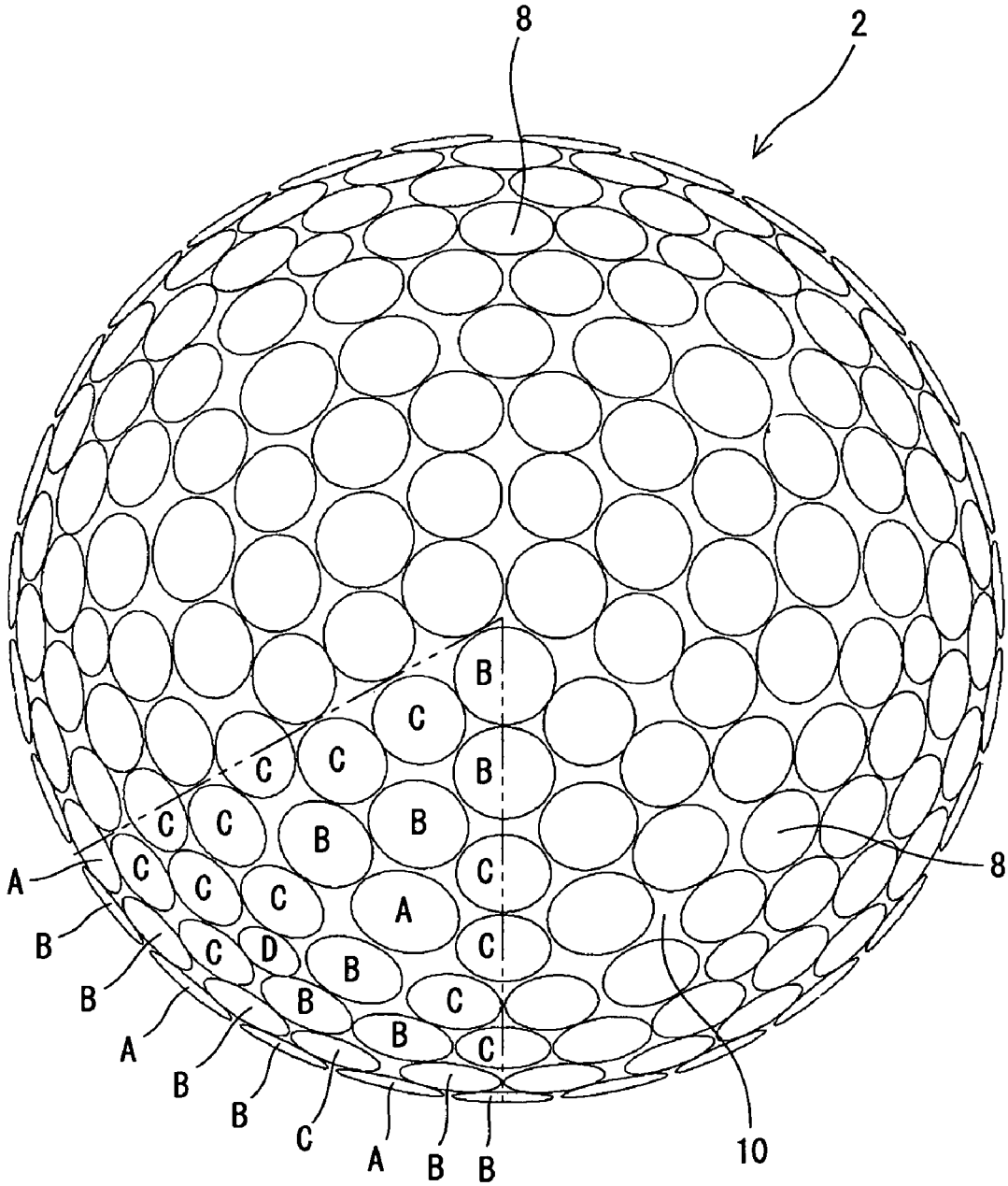
FIG. 2 is an enlarged plan view illustrating the golf ball shown in FIG. 1.
Figure 3:
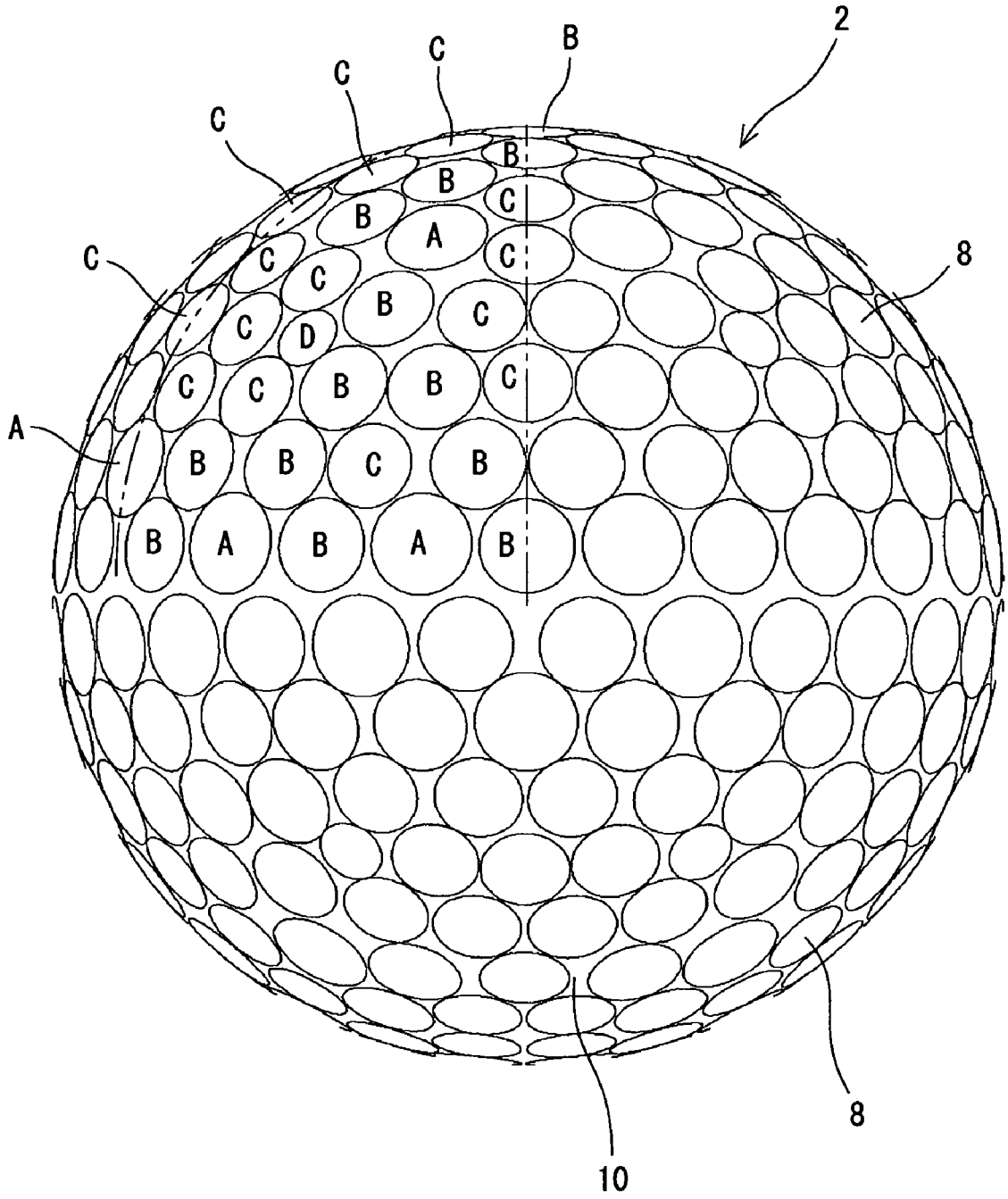
FIG. 3 is a front view illustrating the golf ball shown in FIG. 2.

FIG. 2 is an enlarged plan view illustrating the golf ball 2 shown in FIG. 1, and FIG. 3 is a front view of the same. As is clear from FIG. 2 and FIG. 3, the plane shape of all the dimples 8 is circular. In FIG. 2 and FIG. 3, types of the dimples 8 are illustrated by symbols of A to D in one unit, provided when the surface of the golf ball 2 is comparted into twelve equivalent units. This golf ball 2 has dimples A having a diameter of 4.65 mm, dimples B having a diameter of 4.30 mm, dimples C a diameter of 4.00 mm and dimples D having a diameter of 3.00 mm. The number of the dimples A is 42; the number of the dimples B is 138; the number of the dimples C is 138; and the number of the dimples D is 12. Total number of the dimples 8 of this golf ball 2 is 330.

Figure 4:
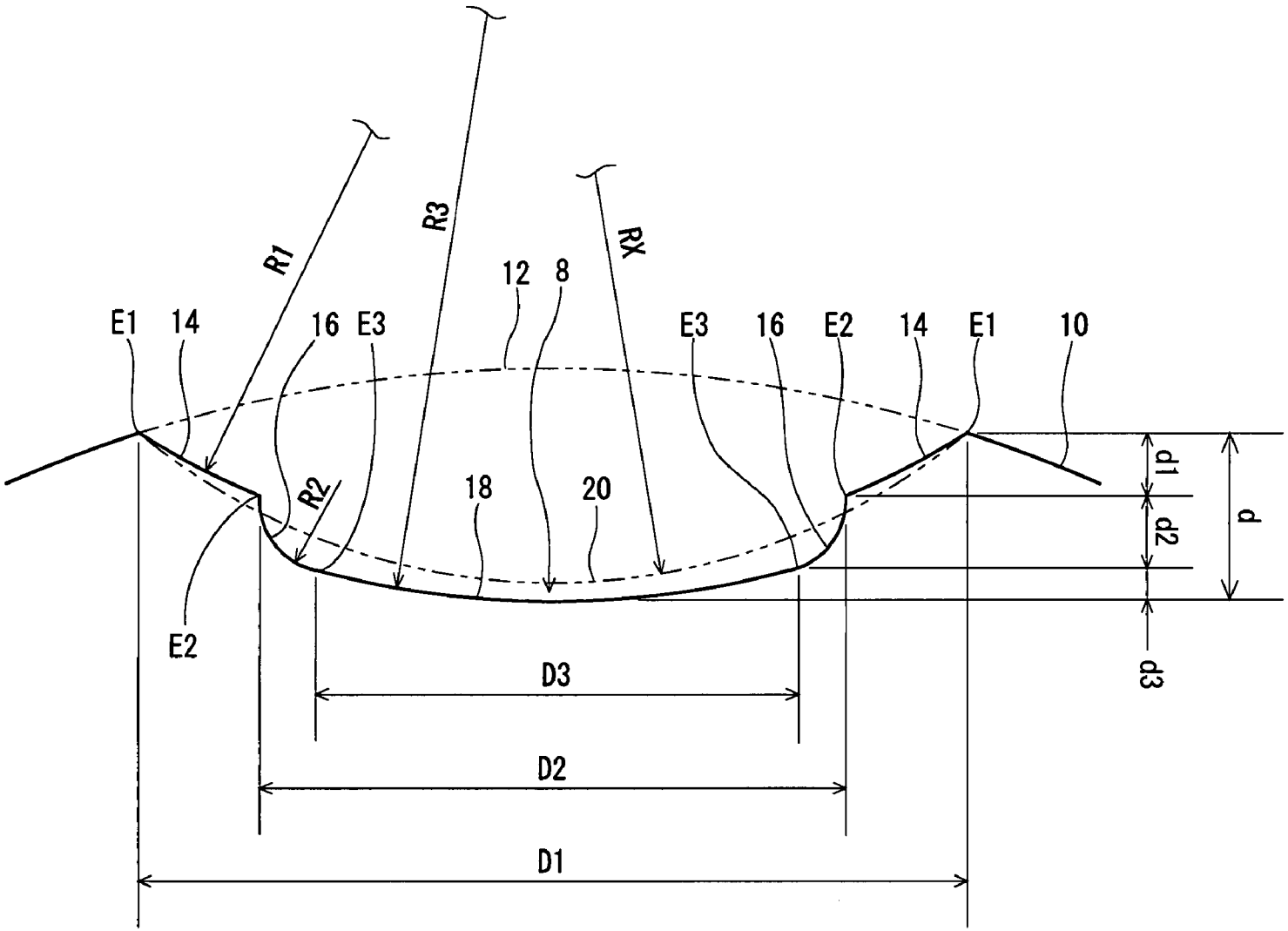
FIG. 4 is an enlarged cross-sectional view illustrating a part of the golf ball shown in FIG. 1.

FIG. 4 is an enlarged cross-sectional view illustrating a part of the golf ball 2 shown in FIG. 1. In this FIG. 4, a cross section along a plane passing through a weighted center of area of the dimple 8 and the center of the golf ball 2 is shown. A top-to-bottom direction in FIG. 4 is an in-depth direction of the dimple 8. The in-depth direction is a direction from the weighted center of area of the dimple 8 toward the center of the golf ball 2. What is indicated by a chain double-dashed line 12 in FIG. 4 is a phantom sphere. The surface of the phantom sphere 12 corresponds to a surface of the golf ball 2 when it is postulated that there is no dimple 8 existed. The dimple 8 is recessed from the phantom sphere 12. The land 10 agrees with the phantom sphere 12.

This dimple 8 has a first side wall face 14, a second side wall face 16 and a bottom face 18. The first side wall face 14 and the second side wall face 16 are ring-shaped. The bottom face 18 is bowl-shaped. The first side wall face 14 is continued to the land 10 at a point E1. The point E1 corresponds to the edge of the dimple 8. The edge E1 defines plane shape of the dimple 8. The second side wall face 16 is positioned to the bottom side of the first side wall face 14. The second side wall face 16 is continued to the first side wall face 14 at a point E2. The bottom face 18 is positioned to the bottom side of the second side wall face 16. The bottom face 18 is continued to the second side wall face 16 at a point E3.

What is indicated by a both-sided arrowhead D1 in FIG. 4 is the diameter of the dimple 8. This diameter D1 is also a maximum diameter of the first side wall face 14. What is indicated by a both-sided arrowhead D2 is a maximum diameter of the second side wall face 16. What is indicated by a both-sided arrowhead D3 is a maximum diameter of the bottom face 18.

What is indicated by a double-dashed line 20 in FIG. 4 is a phantom dimple. Cross-sectional shape of the phantom dimple 20 is a circular arc. Curvature radius of this circular arc is indicated by a symbol Rx in FIG. 4. This phantom dimple 20 is a single radius dimple. Diameter of this phantom dimple 20 is D1. In other words, the diameter of the phantom dimple 20 and the diameter of the dimple 8 are the same. The phantom dimple 20 is envisioned such that its volume becomes equal to the volume of the dimple 8. The phantom curvature radius Rx is usually 5.0 mm or greater and 25.0 mm or less.

The first side wall face 14 is protruded downward. The curvature radius R1 of the first side wall face 14 is equal to or greater than the phantom curvature radius Rx. In other words, the first side wall face 14 curves gently. Air passed through the land 10 flows along the first side wall face 14. Because the curvature of the first side wall face 14 is gentle, air flows smoothly from the land 10 toward the center of the dimple 8. In light of smooth air flow, the curvature radius R1 is preferably equal to or greater than 7.0 mm, and particularly preferably equal to or greater than 8.0 mm. The curvature radius R1 is preferably equal to or less than 30.0 mm.

Maximum diameter line of the first sidewall face 14 passes through the point E1. In other words, the first side wall face 14 does not run off the point E1 outside in the horizontal direction. Accumulation of the air is thereby prevented. The undermost point of the first side wall face 14 agrees with the point E2. In other words, the first side wall face 14 inclines downward from the point E1 to the point E2. Accumulation of the air is thereby prevented.

The second side wall face 16 is protruded downward. The curvature radius R2 of the second side wall face 16 is smaller than the phantom curvature radius Rx. The air passed through the first side wall face 14 flows along the second side wall face 16. Direction of the air is suddenly changed by the second side wall face 16. This change in direction enhances the dimple effect. In light of the dimple effect, the curvature radius R2 is preferably equal to or less than 0.40 time, more preferably equal to or less than 0.30 time, and particularly preferably equal to or less than 0.25 time of the phantom curvature radius Rx. The curvature radius R2 is preferably equal to or greater than 0.10 time of the phantom curvature radius Rx. The curvature radius R2 is preferably 1.5 mm or greater and 5.0 mm or less.

Maximum diameter line of the second side wall face 16 passes through the point E2. In other words, the second side wall face 16 does not run off the point E2 outside in the horizontal direction. Accumulation of the air is thereby prevented. The undermost point of the second side wall face 16 agrees with the point E 3. In other words, the second side wall face 16 inclines downward from the point E2 to the point E3. Accumulation of the air is thereby prevented.

The bottom face 18 is protruded downward. The curvature radius R3 of the bottom face 18 is equal to or greater than the phantom curvature radius Rx. In other words, the bottom face 18 curves gently. The air passed through the second side wall face 16 flows along the bottom face 18. The air is smoothly introduced to the opposite second side wall face 16 by means of this bottom face 18. Direction of the air is suddenly changed by the opposite second side wall face 16. This change in direction enhances the dimple effect. In light of smooth air flow, the curvature radius R3 of the bottom face 18 is preferably equal to or greater than 1.10 times, and more preferably equal to or greater than 1.20 times of the phantom curvature radius Rx. The curvature radius R3 of the bottom face 18 is preferably equal to or less than 1.70 times of the phantom curvature radius Rx. The curvature radius R3 is preferably equal to or greater than 7.0 mm, and particularly preferably equal to or greater than 8.0 mm. The curvature radius R3 is preferably equal to or less than 35.0 mm.

Maximum diameter line of the bottom face 18 passes through the point E3. In other words, the bottom face 18 does not run off the point E3 outside in the horizontal direction. Accumulation of the air is thereby prevented.

Maximum diameter D2 of the second side wall face 16 is preferably 0.60 time or greater and 0.95 time or less of the diameter D1 of the dimple 8. When the diameter D2 is less than the above range, contribution ratio of the second side wall face 16 or the bottom face 18 to the dimple effect may become insufficient. In this respect, the diameter D2 is more preferably equal to or greater than 0.70 time, and particularly preferably equal to or greater than 0.75 time of the diameter D1. When the diameter D2 is beyond the above range, contribution ratio of the first side wall face 14 to the dimple effect may become insufficient. In this respect, the diameter D2 is more preferably equal to or less than 0.93 time, and particularly preferably equal to or less than 0.90 time of the diameter D1.

Maximum diameter D3 of the bottom face 18 is preferably 0.60 time or greater and 0.95 time or less of the diameter D2. When the diameter D3 is less than the above range, contribution ratio of the bottom face 18 to the dimple effect may become insufficient. In this respect, the diameter D3 is more preferably equal to or greater than 0.70 time, and particularly preferably equal to or greater than 0.75 time of the diameter D2. When the diameter D3 is beyond the above range, contribution ratio of the second side wall face 16 to the dimple effect may become insufficient. In this respect, the diameter D3 is more preferably equal to or less than 0.93 time, and particularly preferably equal to or less than 0.90 time of the diameter D2.

What is indicated by a both-sided arrowhead d1 in FIG. 4 is the depth of the first side wall face 14; what is indicated by a both-sided arrowhead d2 is the depth of the second side wall face 16; and what is indicated by a both-sided arrowhead d3 is the depth of the bottom face 18. Sum total of the depth d1, the depth d2 and the depth d3 is the depth d of the dimple 8.

The depth d1 of the first side wall face 14 is preferably 0.10 time or greater and 0.50 time or less of the depth d of the dimple 8. When the depth d1 is less than the above range, contribution ratio of the first side wall face 14 to the dimple effect may become insufficient. In this respect, the depth d1 is more preferably equal to or greater than 0.15 time, and particularly preferably equal to or greater than 0.20 time of the depth d. When the depth d1 is beyond the above range, contribution ratio of the second side wall face 16 or the bottom face 18 to the dimple effect may become insufficient. In this respect, the depth d1 is more preferably equal to or less than 0.45 time, and particularly preferably equal to or less than 0.40 time of the depth d.

The depth d2 of the second side wall face 16 is preferably 0.10 time or greater and 0.60 time or less of the depth d of the dimple 8. When the depth d2 is less than the above range, contribution ratio of the second side wall face 16 to the dimple effect may become insufficient. In this respect, the depth d2 is more preferably equal to or greater than 0.15 time, and particularly preferably equal to or greater than 0.20 time of the depth d. When the depth d2 is beyond the above range, contribution ratio of the first side wall face 14 or the bottom face 18 to the dimple effect may become insufficient. In this respect, the depth d2 is more preferably equal to or less than 0.55 time, and particularly preferably equal to or less than 0.50 time of the depth d.

The depth d3 of the bottom face 18 is preferably 0.05 time or greater and 0.50 time or less of the depth d of the dimple 8. When the depth d3 is less than the above range, contribution ratio of the bottom face 18 to the dimple effect may become insufficient. In this respect, the depth d3 is more preferably equal to or greater than 0.10 time, and particularly preferably equal to or greater than 0.15 time of the depth d. When the depth d3 is beyond the above range, contribution ratio of the first side wall face 14 or the second side wall face 16 to the dimple effect may become insufficient. In this respect, the depth d3 is more preferably equal to or less than 0.45 time, and particularly preferably equal to or less than 0.40 time of the depth d.

The area s of the dimple 8 is an area of a region surrounded by the contour line when the center of the golf ball 2 is viewed at infinity. In instances of a circular dimple, the area s is calculated by the following formula:

$$s=(D1/2)^2 * \pi.$$

In the golf ball 2 shown in FIG. 2 and FIG. 3, the area of the dimple A is 16.98 $mm^2$; the area of the dimple B is 14.52 $mm^2$; the area of the dimple C is 12.57 $mm^2$; and the area of the dimple D is 7.07 $mm^2$.

According to the present invention, ratio of sum total of areas s of all the dimples 8 occupying the surface area of the phantom sphere 12 is referred to as an occupation ratio. From the standpoint that a sufficient dimple effect is achieved, the occupation ratio is preferably equal to or greater than 70%, more preferably equal to or greater than 72%, and particularly preferably equal to or greater than 74%. The occupation ratio is preferably equal to or less than 90%. According to the golf ball 2 shown in FIG. 2 and FIG. 3, total area of the dimples 8 is 4536.3 $mm^2$. Because the surface area of the phantom sphere 12 of this golf ball 2 is 5728.0 $mm^2$, the occupation ratio is 79.2%.

The diameter D1 of the dimple 8 is preferably 2.0 mm or greater and 6.0 mm or less. When the diameter D1 is less than the above range, the dimple effect is hardly achieved. In this respect, the diameter D1 is more preferably equal to or greater than 2.2 mm, and particularly preferably equal to or greater than 2.4 mm. When the diameter D1 is greater than the above range, a fundamental feature of the golf ball 2 which is substantially a sphere may be compromised. In this respect, the diameter D1 is more preferably equal to or less than 5.8 mm, and particularly preferably equal to or less than 5.6 mm.

It is preferred that the depth d of the dimple 8 is 0.05 mm or greater and 0.60 mm or less. When the depth is less than the above range, a hopping trajectory may be provided. In this respect, the depth is more preferably equal to or greater than 0.08 mm, and particularly preferably equal to or greater than 0.10 mm. When the depth is beyond than the above range, a dropping trajectory may be provided. In this respect, the depth is more preferably equal to or less than 0.45 mm, and particularly preferably equal to or less than 0.40 mm.

In the present invention, the term "dimple volume" means a volume of a part surrounded by a plane including the contour of the dimple 8, and the surface of the dimple 8. It is preferred that total volume of the dimples 8 is 250 $mm^3$ or greater and 400 $mm^3$ or less. When the total volume is less than the above range, a hopping trajectory may be provided. In this respect, the total volume is more preferably equal to or greater than 260 $mm^3$, and particularly preferably equal to or greater than 270 $mm^3$. When the total volume is beyond the above range, a dropping trajectory may be provided. In this respect, the total volume is more preferably equal to or less than 390 $mm^3$, and particularly preferably equal to or less than 380 $mm^3$.

It is preferred that total number of the dimples 8 is 200 or greater and 500 or less. When the total number is less than the above range, the dimple effect is hardly achieved. In this respect, the total number is more preferably equal to or greater than 240, and particularly preferably equal to or greater than 260. When the total number is beyond the above range, the dimple effect is hardly achieved due to small size of the individual dimples 8. In this respect, the total number is more preferably equal to or less than 480, and particularly preferably equal to or less than 460.

The dimple 8 depicted in FIG. 4 meets the following requirements of (a) to (c):

(a) having a first side wall face 14 that has a curvature radius R1 which is equal to or greater than a virtual curvature radius Rx;

(b) having a second side wall face 16 that is positioned to the bottom side of this first side wall face 14 and has a curvature radius R2 which is smaller than the virtual curvature radius Rx; and (c) having a bottom face 18 that is positioned to the bottom side of this second sidewall face 16 and has a curvature radius R3 which is equal to or greater than the virtual curvature radius Rx. Ratio of number of the dimples 8 that meet these requirements of (a) to (c) occupying total number of the dimples 8 is preferably equal to or greater than 50%, more preferably equal to or greater than 70%, and particularly preferably equal to or greater than 85%. This ratio is ideally 100%.

EXAMPLES

Example 1

A rubber composition was obtained by kneading 100 parts by weight of polybutadiene (trade name "BR-11", available from JSR Corporation), 24.5parts by weight of zinc diacrylate, 10 parts of zinc oxide, 15 parts by weight of barium sulfate and 0.8 part by weight of dicumyl peroxide. This rubber composition was placed into a mold having upper and lower mold half each having a hemispherical cavity, and heated at 160° C. for 20 minutes to obtain a core having a diameter of 38.1 mm. On the other hand, a resin composition was obtained by kneading 50 parts by weight of an ionomer resin (trade name "Himilan 1605", available from Du Pont-MITSUI POLYCHEMICALS Co.,Ltd.), 50parts by weight of another ionomer resin (trade name "Himilan 1706", available from Du Pont-MITSUI POLYCHEMICALS Co., Ltd.) and 3 parts of titanium dioxide. The aforementioned core was placed into a mold having numerous protrusions on the inner surface, followed by the injection of the aforementioned resin composition around the core according to an injection molding method to form a cover having a thickness of 2.3 mm. Numerous dimples having a shape inverted from the shape of the protrusion were formed on the cover. Paint was applied on this cover to give a golf ball of Example 1 having a diameter of 42.7 mm and a weight of about 45.4 g. This golf ball had a compression of about 85. Specifications of the dimples of this golf ball are presented in Table 1 below.

Examples 2 to 5 and Comparative Examples 1 to 6

In a similar manner to Example 1 except that the mold was changed to alter specifications of the dimples as presented in Table 1, Table 2 and Table 3 below, golf balls of Examples 2 to 5 and Comparative Examples 1 to 6 were obtained. In the golf ball of Comparative Example 1, the curvature radius R1 of the first side wall face is smaller than the phantom curvature radius Rx. In the golf ball of Comparative Example 2, the curvature radius R3 of the bottom face is smaller than the phantom curvature radius Rx. The golf balls of Comparative Examples 3 and 5 have double radius dimples. In the golf ball of Comparative Example 4, dimples A, B and C meet the requirements of (a) to (c), however, dimples A', B', C' and D' do not meet the requirements of (a) to (c). The golf ball of Comparative Example 6 has single radius dimples.

TABLE 1

| | | | Spefication of Dimples | | | | | | | | | | | | |
|---|---|---|---|---|---|---|---|---|---|---|---|---|---|---|---|
| | | | Diameter (mm) | | | Depth (mm) | | | | Curvature radius (mm) | | | | Volume | Plan view |
| | Type | Number | D1 | D2 | D3 | d1 | d2 | d3 | d | R1 | R2 | R3 | Rx | ($mm^3$) | Front view |
| Example 1 | A | 42 | 4.650 | 3.938 | 3.150 | 0.040 | 0.043 | 0.047 | 0.130 | 19.2 | 3.0 | 25.4 | 19.2 | 1.199 | FIG. 2 |
| | B | 138 | 4.300 | 3.642 | 2.914 | 0.040 | 0.042 | 0.048 | 0.130 | 16.5 | 3.0 | 21.8 | 16.5 | 1.025 | FIG. 3 |
| | C | 138 | 4.000 | 3.388 | 2.710 | 0.040 | 0.042 | 0.048 | 0.130 | 14.3 | 3.0 | 19.1 | 14.3 | 0.887 | |
| | D | 12 | 3.000 | 2.542 | 2.034 | 0.040 | 0.041 | 0.049 | 0.130 | 8.0 | 3.0 | 11.3 | 8.0 | 0.500 | |
| Example 2 | A | 42 | 4.650 | 4.309 | 3.447 | 0.020 | 0.054 | 0.046 | 0.120 | 19.2 | 3.0 | 32.3 | 19.2 | 1.199 | FIG. 2 |
| | B | 138 | 4.300 | 3.985 | 3.108 | 0.020 | 0.057 | 0.043 | 0.120 | 16.5 | 3.0 | 28.0 | 16.5 | 1.025 | FIG. 3 |
| | C | 138 | 4.000 | 3.707 | 2.080 | 0.020 | 0.061 | 0.039 | 0.120 | 14.3 | 3.0 | 24.7 | 14.3 | 0.887 | |
| | D | 12 | 3.000 | 2.781 | 1.808 | 0.020 | 0.073 | 0.027 | 0.120 | 8.0 | 3.0 | 15.8 | 8.0 | 0.500 | |

TABLE 1-continued

| | | | Spefication of Dimples | | | | | | | | | | | | |
|---|---|---|---|---|---|---|---|---|---|---|---|---|---|---|---|
| | | | Diameter (mm) | | | Depth (mm) | | | | Curvature radius (mm) | | | | Volume | Plan view |
| | Type | Number | D1 | D2 | D3 | d1 | d2 | d3 | d | R1 | R2 | R3 | Rx | ($mm^3$) | Front view |
| Example 3 | A | 42 | 4.650 | 3.417 | 2.734 | 0.065 | 0.062 | 0.008 | 0.135 | 19.2 | 3.0 | 23.3 | 19.2 | 1.199 | FIG. 2 |
| | B | 138 | 4.300 | 3.160 | 2.465 | 0.065 | 0.067 | 0.003 | 0.135 | 16.5 | 3.0 | 19.9 | 16.5 | 1.025 | FIG. 3 |
| | C | 138 | 4.000 | 2.940 | 2.205 | 0.065 | 0.036 | 0.034 | 0.135 | 14.3 | 3.0 | 17.3 | 14.3 | 0.887 | |
| | D | 12 | 3.000 | 2.207 | 1.324 | 0.065 | 0.052 | 0.018 | 0.135 | 8.0 | 3.0 | 10.0 | 8.0 | 0.500 | |
| Example 4 | A | 42 | 4.650 | 3.184 | 2.547 | 0.075 | 0.027 | 0.033 | 0.135 | 19.2 | 3.0 | 24.1 | 19.2 | 1.199 | FIG. 2 |
| | B | 138 | 4.300 | 2.945 | 2.297 | 0.075 | 0.029 | 0.031 | 0.135 | 16.5 | 3.0 | 20.7 | 16.5 | 1.025 | FIG. 3 |
| | C | 138 | 4.000 | 2.740 | 2.082 | 0.075 | 0.031 | 0.029 | 0.135 | 14.3 | 3.0 | 18.0 | 14.3 | 0.887 | |
| | D | 12 | 3.000 | 2.057 | 1.440 | 0.075 | 0.036 | 0.024 | 0.135 | 8.0 | 3.0 | 10.5 | 8.0 | 0.500 | |

TABLE 2

| | | | Spefication of Dimples | | | | | | | | | | | | |
|---|---|---|---|---|---|---|---|---|---|---|---|---|---|---|---|
| | | | Diameter (mm) | | | Depth (mm) | | | | Curvature radius (mm) | | | | Volume | Plan view |
| | Type | Number | D1 | D2 | D3 | d1 | d2 | d3 | d | R1 | R2 | R3 | Rx | ($mm^3$) | Front view |
| Example 5 | A | 42 | 4.650 | 4.483 | 3.497 | 0.010 | 0.060 | 0.060 | 0.130 | 19.2 | 3.0 | 26.2 | 19.2 | 1.199 | FIG. 2 |
| | B | 138 | 4.300 | 4.145 | 3.316 | 0.010 | 0.054 | 0.066 | 0.130 | 16.5 | 3.0 | 20.3 | 16.5 | 1.025 | FIG. 3 |
| | C | 138 | 4.000 | 3.856 | 3.085 | 0.010 | 0.053 | 0.067 | 0.130 | 14.3 | 3.0 | 17.6 | 14.3 | 0.887 | |
| | D | 12 | 3.000 | 2.893 | 2.170 | 0.010 | 0.036 | 0.084 | 0.130 | 8.0 | 3.0 | 10.2 | 8.0 | 0.500 | |
| Comparative example 1 | A | 42 | 4.650 | 4.073 | 3.258 | 0.040 | 0.039 | 0.041 | 0.120 | 15.9 | 3.0 | 31.9 | 19.2 | 1.199 | FIG. 2 |
| | B | 138 | 4.300 | 3.766 | 3.013 | 0.040 | 0.040 | 0.040 | 0.120 | 13.6 | 3.0 | 27.7 | 16.5 | 1.025 | FIG. 3 |
| | C | 138 | 4.000 | 3.504 | 2.803 | 0.040 | 0.040 | 0.040 | 0.120 | 11.8 | 3.0 | 23.8 | 14.3 | 0.887 | |
| | D | 12 | 3.000 | 2.630 | 2.104 | 0.040 | 0.038 | 0.042 | 0.120 | 6.7 | 3.0 | 14.0 | 8.0 | 0.500 | |
| Comparative example 2 | A | 42 | 4.650 | 3.720 | 2.976 | 0.040 | 0.047 | 0.063 | 0.150 | 24.4 | 3.0 | 17.3 | 19.2 | 1.199 | FIG. 2 |
| | B | 138 | 4.300 | 3.441 | 2.753 | 0.040 | 0.047 | 0.063 | 0.150 | 20.9 | 3.0 | 14.8 | 16.5 | 1.025 | FIG. 3 |
| | C | 138 | 4.000 | 3.201 | 2.561 | 0.040 | 0.047 | 0.063 | 0.150 | 18.1 | 3.0 | 12.9 | 14.3 | 0.887 | |
| | D | 12 | 3.000 | 2.402 | 1.201 | 0.040 | 0.094 | 0.016 | 0.150 | 10.2 | 3.0 | 7.4 | 8.0 | 0.500 | |
| Comparative example 3 | A | 42 | 4.650 | 3.720 | — | 0.040 | 0.118 | — | 0.158 | 24.4 | 14.7 | — | 19.2 | 1.199 | FIG. 2 |
| | B | 138 | 4.300 | 3.441 | — | 0.040 | 0.118 | — | 0.158 | 20.9 | 12.6 | — | 16.5 | 1.025 | FIG. 3 |
| | C | 138 | 4.000 | 3.201 | — | 0.040 | 0.118 | — | 0.158 | 18.1 | 10.9 | — | 14.3 | 0.887 | |
| | D | 12 | 3.000 | 2.402 | — | 0.040 | 0.118 | — | 0.158 | 10.2 | 6.2 | — | 8.0 | 0.500 | |

TABLE 3

Figure 5:
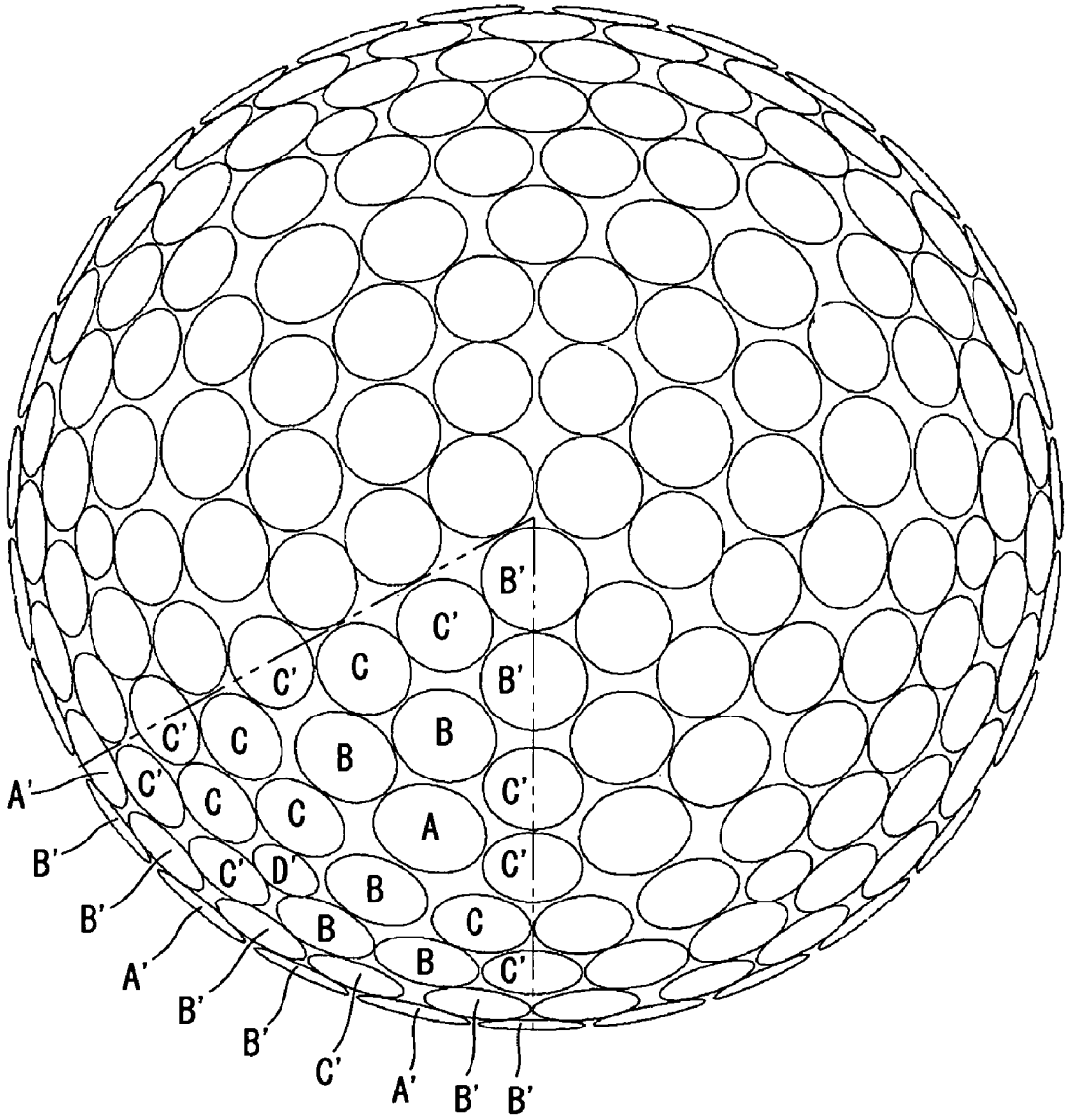
FIG. 5 is a plan view illustrating a golf ball according to Comparative Example 4.
Figure 6:
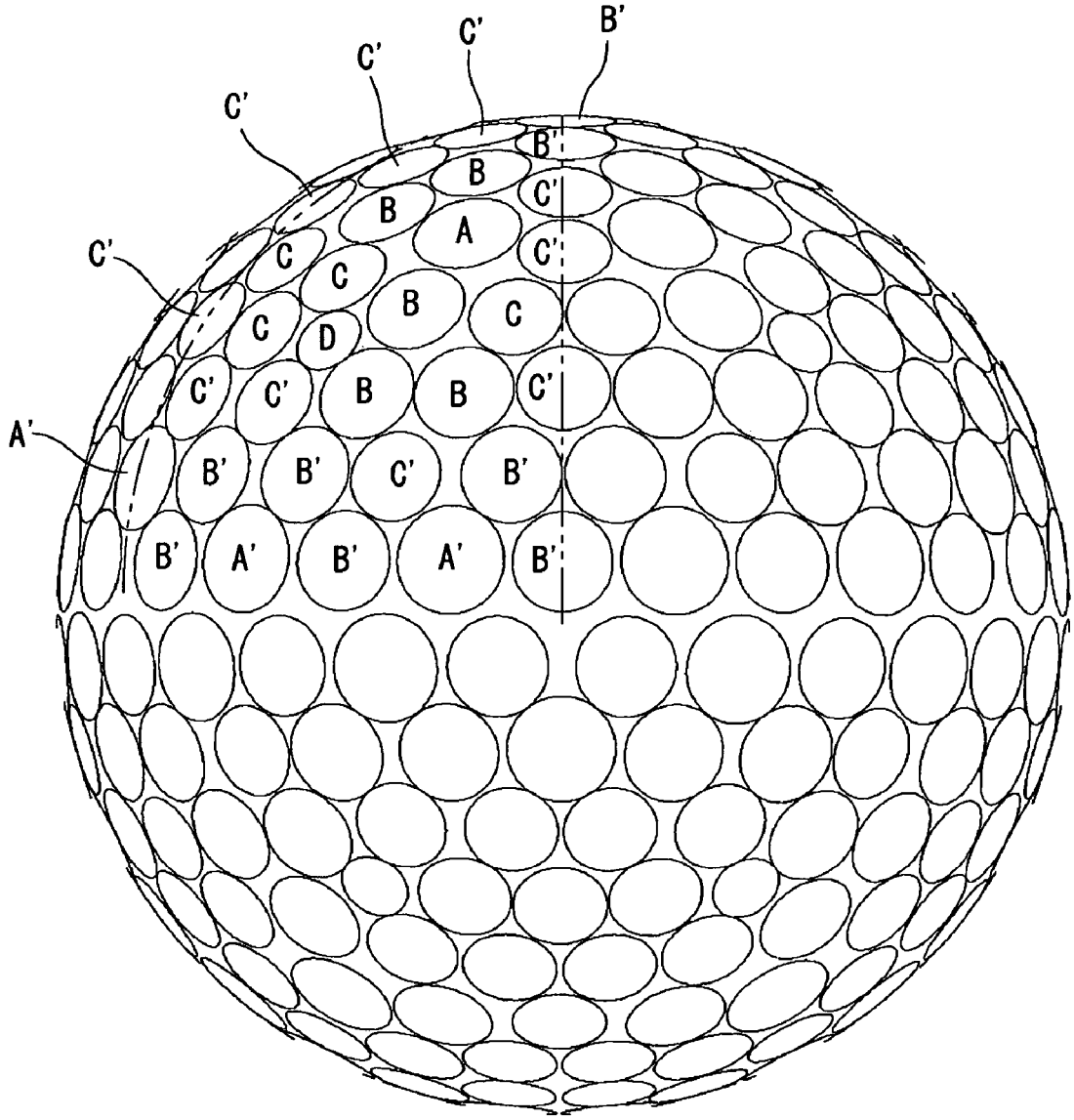
FIG. 6 is a front view illustrating the golf ball shown in FIG. 5.

| | | | Spefication of Dimples | | | | | | | | | | | | |
|---|---|---|---|---|---|---|---|---|---|---|---|---|---|---|---|
| | | | Diameter (mm) | | | Depth (mm) | | | | Curvature radius (mm) | | | | Volume | Plan view |
| | Type | Number | D1 | D2 | D3 | d1 | d2 | d3 | d | R1 | R2 | R3 | Rx | ($mm^3$) | Front view |
| Comparative example 4 | A | 12 | 4.650 | 3.938 | 3.150 | 0.040 | 0.043 | 0.047 | 0.130 | 19.2 | 3.0 | 25.4 | 19.2 | 1.199 | FIG. 5 |
| | B | 60 | 4.300 | 3.642 | 2.914 | 0.040 | 0.042 | 0.048 | 0.130 | 16.5 | 3.0 | 21.8 | 16.5 | 1.025 | FIG. 6 |
| | C | 60 | 4.000 | 3.388 | 2.710 | 0.040 | 0.042 | 0.048 | 0.130 | 14.3 | 3.0 | 19.1 | 14.3 | 0.887 | |
| | A' | 30 | 4.650 | — | — | — | — | — | 0.141 | 19.2 | — | — | 19.2 | 1.199 | |
| | B' | 78 | 4.300 | — | — | — | — | — | 0.141 | 16.5 | — | — | 16.5 | 1.025 | |
| | C' | 78 | 4.000 | — | — | — | — | — | 0.141 | 14.3 | — | — | 14.3 | 0.887 | |
| | D' | 12 | 3.000 | — | — | — | — | — | 0.141 | 8.0 | — | — | 8.0 | 0.500 | |
| Comparative example 5 | A | 42 | 4.650 | 3.891 | — | 0.054 | 0.066 | — | 0.120 | 3.0 | 29.0 | — | 19.2 | 1.199 | FIG. 2 |
| | B | 138 | 4.300 | 3.457 | — | 0.060 | 0.060 | — | 0.120 | 3.0 | 25.2 | — | 16.5 | 1.025 | FIG. 3 |
| | C | 138 | 4.000 | 3.068 | — | 0.067 | 0.053 | — | 0.120 | 3.0 | 22.1 | — | 14.3 | 0.887 | |
| | D | 12 | 3.000 | 1.979 | — | 0.084 | 0.036 | — | 0.120 | 3.0 | 13.6 | — | 8.0 | 0.500 | |
| Comparative example 6 | A | 42 | 4.650 | — | — | — | — | — | 0.141 | 19.2 | — | — | 19.2 | 1.199 | FIG. 2 |
| | B | 138 | 4.300 | — | — | — | — | — | 0.141 | 16.5 | — | — | 16.5 | 1.025 | FIG. 3 |
| | C | 138 | 4.000 | — | — | — | — | — | 0.141 | 14.3 | — | — | 14.3 | 0.887 | |
| | D | 12 | 3.000 | — | — | — | — | — | 0.141 | 8.0 | — | — | 8.0 | 0.500 | |

[Travel Distance Test]

A driver having a metal head (trade name "XXIO", available from Sumitomo Rubber Industries, Ltd.; shaft hardness: X, loft angle: 9°) was attached to a swing machine, available from True Temper Co. Then the golf ball was hit under the condition of the head speed being 49 m/sec, the launch angle being approximately 11° and the initial spin rate being approximately 3000 rpm. Accordingly, distance from the launching point to the point where the ball stopped was measured. Under the condition during the test, it was almost windless. Mean values of 20 times measurement are shown in Table 4 below.

TABLE 4

Results of evaluation

| | Example 1 | Example 2 | Example 3 | Example 4 | Example 5 | Compara. example 1 | Compara. example 2 | Compara. example 3 | Compara. example 4 A-C | Compara. example 4 A'-D' | Compara. example 5 | Compara. example 6 |
|---|---|---|---|---|---|---|---|---|---|---|---|---|
| D2/D1 | 0.85 | 0.93 | 0.74 | 0.69 | 0.96 | 0.88 | 0.80 | — | 0.85 | — | — | — |
| d1/d | 0.31 | 0.17 | 0.48 | 0.56 | 0.08 | 0.33 | 0.27 | — | 0.31 | — | — | — |
| R1 | ≧Rx | ≧Rx | ≧Rx | ≧Rx | ≧Rx | <Rx | ≧Rx | — | ≧Rx | — | — | — |
| R2 | <Rx | <Rx | <Rx | <Rx | <Rx | <Rx | <Rx | — | <Rx | — | — | — |
| R3 | ≧Rx | ≧Rx | ≧Rx | ≧Rx | ≧Rx | ≧Rx | <Rx | — | ≧Rx | — | — | — |
| Total number of dimples | 330 | 330 | 330 | 330 | 330 | 330 | 330 | 330 | 330 | | 330 | 330 |
| Total volume ($mm^3$) | 320 | 320 | 320 | 320 | 320 | 320 | 320 | 320 | 320 | | 320 | 320 |
| Occupation ratio (%) | 79.3 | 79.3 | 79.3 | 79.3 | 79.3 | 79.3 | 79.3 | 79.3 | 79.3 | | 79.3 | 79.3 |
| Ratio (%)* | 100 | 100 | 100 | 100 | 100 | 0 | 0 | 0 | 40 | | 0 | 0 |
| Travel distance (m) | 238.1 | 237.5 | 236.9 | 236.4 | 236.2 | 235.3 | 235.1 | 234.0 | 234.3 | | 233.4 | 231.0 |

*Ratio of number of dimples that meet the requirements of (a) to (c) occupying total number of the dimples As is shown in Table 4, the golf balls of Examples are excellent in the flight performance. Therefore, advantages of the present invention are clearly suggested by these results of evaluation.

The description herein above is just for an illustrative example, therefore, various modifications can be made without departing from the principles of the present invention. The dimples that meet the requirements of (a) to (c) as described above are suitable for not only two-piece golf balls, but also one-piece golf balls, multi-piece golf balls and wound golf balls.

What is claimed is:

1. A golf ball having numerous dimples on the surface thereof, said golf ball having a portion of number of dimples having:

a first side wall face that has a curvature radius R1 which is equal to or greater than a virtual curvature radius Rx; a second side wall face that is positioned to the bottom side of said first side wall face and has a curvature radius R2 which is smaller than the virtual curvature radius Rx; and a bottom face that is positioned to the bottom side of said second side wall face and has a curvature radius R3 which is equal to or greater than the virtual curvature radius Rx, wherein the portion of number of dimples is equal to or greater than 50% of the total number of dimples.

2. The golf ball according to claim 1, wherein the depth of said first side wall face is 0.10 times or greater and 0.50 times or less of the depth of the dimple.

3. The golf ball according to claim 1, wherein a maximum diameter of said second side wall face is 0.60 times or greater and 0.95 times or less of the diameter of the dimple.

4. The golf ball according to claim 1, wherein said first side wall face, second wall face and bottom face are protruded downward.

5. The golf ball according to claim 2 wherein a maximum diameter of said second side wall face is 0.60 times or greater and 0.95 times or less of the diameter of the dimple.

6. The golf ball according to claim 5 wherein said first side wall face, second wall face and bottom face are protruded downward.

7. The golf ball according to claim 1 wherein the portion of number of dimples is equal to or greater than 70% of the total number of dimples.

8. The golf ball according to claim 1 wherein the portion of number of dimples is equal to or greater than 72% of the total number of dimples.

9. The golf ball according to claim 1 wherein the portion of number of dimples is equal to or greater than 74% of the total number of dimples, and equal to or less than 90%.

10. The golf ball according to claim 2 wherein the depth of said first side wall face is 0.15 times or greater and 0.45 times or less of the depth of the dimple.

11. The golf ball according to claim 2 wherein the depth of said first side wall face is 0.20 times or greater and 0.40 times or less of the depth of the dimple.

12. The golf ball according to claim 3 wherein a maximum diameter of said second side wall face is 0.70 times or greater and 0.93 times or less of the diameter of the dimple.

13. The golf ball according to claim 3 wherein a maximum diameter of said second side wall face is 0.75 times or greater and 0.90 times or less of the diameter of the dimple.

* * * * *